US005632826A

United States Patent [19]

Hultin-Stigenberg et al.

[11] Patent Number: 5,632,826

[45] Date of Patent: May 27, 1997

[54] QUASICRYSTALLINE PRECIPITATION HARDENED METAL ALLOY AND METHOD OF MAKING

[75] Inventors: Anna Hultin-Stigenberg; Jan-Olof Nilsson; Ping Liu, all of Sandviken, Sweden

[73] Assignee: Sandvik AB, Sandviken, Sweden

[21] Appl. No.: 319,648

[22] Filed: Oct. 7, 1994

[30] Foreign Application Priority Data

Oct. 7, 1993 [SE] Sweden ..... 9303280

[51] Int. Cl.[6] ..... C22C 38/22; C21D 6/02

[52] U.S. Cl. ..... 148/326; 148/328; 148/607; 148/622

[58] Field of Search ..... 148/326, 328, 148/607, 622

[56] References Cited

U.S. PATENT DOCUMENTS 3,408,178 10/1968 Myers et al. .
5,288,342 2/1994 Job ..... 148/320

FOREIGN PATENT DOCUMENTS 561375 9/1993 European Pat. Off. .
587186 3/1994 European Pat. Off. .

OTHER PUBLICATIONS

Kelton, K.F., "Quasicrystals: structure and stability", *International Materials Review*, 1993, vol. 38 No. 3, pp. 105–137.

Hovmöller, Sven, "CRISP: crystallographic image processing in a personal computer", *Ultramicroscopy*, 1992, vol. 41, pp. 121–135.

Schechtman, D., Blech, I., Gratias, D., and Cahn, J.W., "Metallic Phase with Long–Range Orientational Order and No Translational Symmetry", *Physical Review Letters*, 12 Nov. 1984, vol. 53, No. 20, pp. 1951–1953.

Liu, P., Dunlop, G.L. and Arnberg, L., "The Effect of Chromium Content on the Microstructure and Properties of Rapidly Solidified Al–Mn–Cr Alloys", *International Journal of Rapid Solidification*, 1990, vol. 5, pp. 229–249.

Hu, Z.W., Jiang, X.L., Zhu, J., and Hsu, S.S., "Formation of quasicrystalline phase and its orientation relationship with the parent phase in a duplex stainless steel", *Philosophical Magazine Letters*, 1990, vol. 61, No. 3, pp. 115–118.

*Primary Examiner*—Deborah Yee
*Attorney, Agent, or Firm*—Burns, Doane, Swecker & Mathis, L.L.P.

[57] ABSTRACT

A precipitation hardened metallic alloy is provided in which the strengthening is based on the precipitation of particles. The strengthening particles have a quasicrystalline structure, said structure being essentially maintained at aging times up to 1000 h and tempering treatments up to 650° C., the strengthening involving an increase in tensile strength of at least 200 MPa.

11 Claims, 1 Drawing Sheet

QUASICRYSTALLINE PRECIPITATION HARDENED METAL ALLOY AND METHOD OF MAKING

BACKGROUND OF THE INVENTION

The present invention is concerned with the class of metal alloys in which the mechanism described below can be used for strengthening. More especially, the mechanism is based on the precipitation of particles. In particular, the concern is with the class of iron-based metal alloys in which strengthening is based on the precipitation of particles having a quasicrystalline structure.

OBJECTS AND SUMMARY OF THE INVENTION

It is an object of this invention to avoid or alleviate the problems of the prior art.

It is further an object of the present invention to provide an iron-based alloy utilizing a precipitation hardening mechanism which gives rise to an unusually high hardening response in strength not only compared with other precipitation hardening mechanisms, but also compared with other hardening mechanisms for metal alloys in general.

It is another object of the present invention to provide an iron-based alloy utilizing a precipitation hardening mechanism which involves not only a high hardening response, but also offers a unique resistance to overaging, i.e., conditions which allow the high response in strength to be sustained for a long time, even at relatively high temperatures. This means that softening can be avoided in practice.

It is an additional object of the present invention to provide an iron-based alloy having a precipitation hardening mechanism which does not require a complicated processing of the metal alloy or a complicated heat treatment sequence in order to enable the precipitation of quasicrystal particles resulting in a high hardening response in strength and a high resistance to overaging.

In one aspect of the invention there is provided a precipitation hardened iron-based alloy in which the strengthening is based on the precipitation of particles wherein the particles have a quasicrystalline structure, said structure being essentially maintained at aging times up to 1000 h and tempering treatments up to 650° C., the strengthening involving a tensile strength of the alloy of at least 200 MPa.

Other aspects of the invention include the use of this alloy in the manufacture of medical and dental components, wire of a diameter less than 15 mm, bars of a diameter less than 70 mm, strips of a thickness less than 10 mm and tubes with an outer diameter of less than 450 mm and wall thickness of less than 100 mm comprised of the precipitation hardened iron-based alloy described above.

DETAILED DESCRIPTION OF THE PREFERRED EMBODIMENTS OF THE INVENTION

Figure 1:
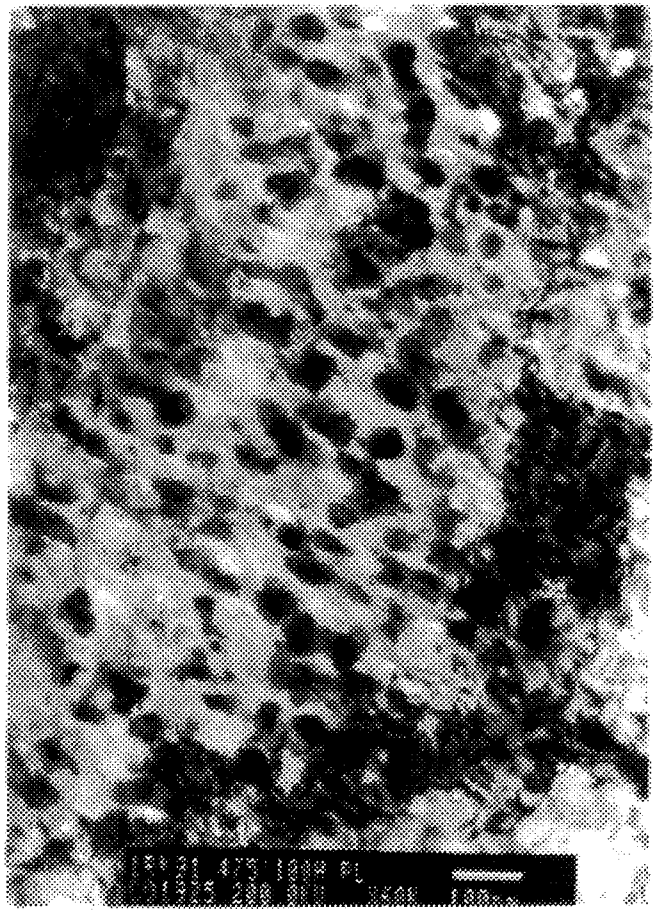
FIG. 1 is a photomicrograph $10^5\times$ of a portion of the iron-based alloy of the present invention.

Traditionally, there are a number of various types of precipitation hardening mechanisms used in metal alloys.

There is, for instance, precipitation of different types of carbides in high speed steel, precipitation of intermetallic phases such as, e.g., $\eta$-$Ni_3Ti$ or $\beta$-NiAl in precipitation hardenable stainless steels, precipitation of intermetallic phases such as $\theta$-$CuAl_2$ in aluminum alloys and $\gamma$-CuBe in copper based alloys. These types of crystalline precipitates often give a significant contribution to strength but they suffer from being sensitive to overaging which implies that loss of strength can be a problem for aging times above about 4 h. All these types of precipitation hardening mechanisms are basically similar; that is, the hardening is based on the precipitation of a phase or particle with a perfectly crystalline structure.

Quasicrystals have structures that are neither crystalline nor amorphous but may be regarded as intermediate structures with associated diffraction patterns that are characterized by, among others, golden mean between the length of adjacent lattice vectors, five-fold orientation symmetries and absence of translation symmetries. Such structures are well-defined and their characteristics together with the results from various investigations of the conditions under which quasicrystals form have been summarized in an overview by Kelton (*International Materials Review*, vol. 38, no. 3, p. 105, 1993). The presence of quasicrystalline structures has mostly been reported in materials which have been either rapidly quenched from a liquid state or cooled to supersaturation (See, for example, EP O 587 186 A1 and EP O 561 375 A2). The materials have in these cases therefore not reached thermodynamic equilibrium or even metastability. Moreover, there is no report on the possibility of using quasicrystalline precipitation in a thermodynamically stable structure as a hardening mechanism in metal alloys produced according to normal metallurgical practice.

A purpose of the present invention was therefore to find a precipitation hardening mechanism, which can be employed in commercial iron-based alloy systems and which is superior to the previously known hardening mechanisms which are all based on the precipitation of a crystalline type of phase or particle. This mechanism should not require any complicated processing of the material or any complicated heat treatment procedure during the hardening. It should involve precipitation of particles which are precipitated from a material with a normal crystalline structure. This also implies that rapid quenching from a liquid state or supersaturation of the material should not be required for the precipitation to take place. The class of metal alloys in which this precipitation hardening mechanism should be possible to use ought to be suitable to be processed in the shape of wire, tube, bar and strip for further use in applications such as dental and medical components such as instruments, springs and fasteners as well as other components within the purview of the skilled artisan.

The experimental iron-based material used to demonstrate this mechanism was a so-called maraging steel, i.e., a type of precipitation hardenable stainless steel, with the following composition in weight %.

TABLE OF CHEMICAL COMPOSITION OF THE EXPERIMENTAL MATERIAL IN WEIGHT PERCENT

| C | Si | Mn | Cr | Ni | Mo | Ti | Cu | Other Elements | Rest |
|---|---|---|---|---|---|---|---|---|---|
| .009 | .15 | .32 | 12.20 | 8.99 | 4.02 | .87 | 1.95 | <.5 | Fe |

The material was produced according to normal metallurgical practice in steel industry in a full scale HF furnace and hot rolled down to wire rod of 5.5 mm diameter followed by cold drawing down to wire of 1 mm diameter, including appropriate intermediate annealing steps. This resulted in a large volume fraction of martensite. Homogenization of the distribution of alloying elements was reached by a so-called soaking treatment well above 1000° C., i.e., at temperatures where, for all practical purposes, the microstructure may be regarded as being in an equilibrium condition.

Samples in the form of 1 mm diameter were wire heat treated in the temperature range 375°–500° C. and subsequently examined using analytical transmission electron microscopy (ATEM) in a microscope of the type JEOL 2000 FX operating at 200 kV, provided with a LINK AN 10,000 system for energy dispersive X-ray analysis. High resolution electron microscopy (HREM) was performed in a JEOL 4000 EX instrument operating at 400 kV, provided with a top entry stage.

Thin foils for ATEM were electropolished at a voltage of 17 V and a temperature of −30° C. using an electrolyte of 15% perchloric acid in methanol. It was found that diffraction analysis of precipitates was facilitated when the matrix was removed as is the case in extraction replicas. Extraction replicas were obtained by etching in a solution of 12.5 g $Cu_2Cl$, 50 ml ethanol and 50 ml HCl followed by coating with a thin layer of carbon. The replica was stripped from the specimen by etching in 5% Br and water-free methanol.

Extraction of residue for structural analysis was carried out in a solution of 394 ml HCl in 1500 ml ethanol. Extracted residue was examined in a Guiner-Hägg XDC 700 X-ray diffraction camera. The residue was also applied on a perforated carbon film and subsequently analyzed in a HREM.

Fourier transformation of small areas in the HREM images was carried out in a system termed CRISP described in S. Hovmöller, *Ultramicroscopy*, vol. 41, p. 121, 1992. The aim of these experiments was to perform diffraction analysis of extremely small areas, i.e., areas that were smaller than the size of the smallest selected area aperture available.

Aging at 475° C. resulted in the instantaneous precipitation of particles. After 4 h, the particles had grown to a diameter of typically 1 nm. After aging at 475° C. for 100 h, the particles had grown to a size of 50–100 nm, an example of which is given in FIG. 1. Further aging at this temperature showed no sign of particle growth up to a total aging time of 1000 h. Since 1000 h is an unusually long aging time there is reason to believe that the particles have already reached their stable crystallography and that no crystallographic transformation of the particles will occur. This indicates that the particles are extremely resistant to overaging. A thorough investigation of the microstructure using ATEM showed that the majority of precipitates had the same crystallographic structure, viz a quasicrystalline structure as will be described in detail below.

Figure 2:
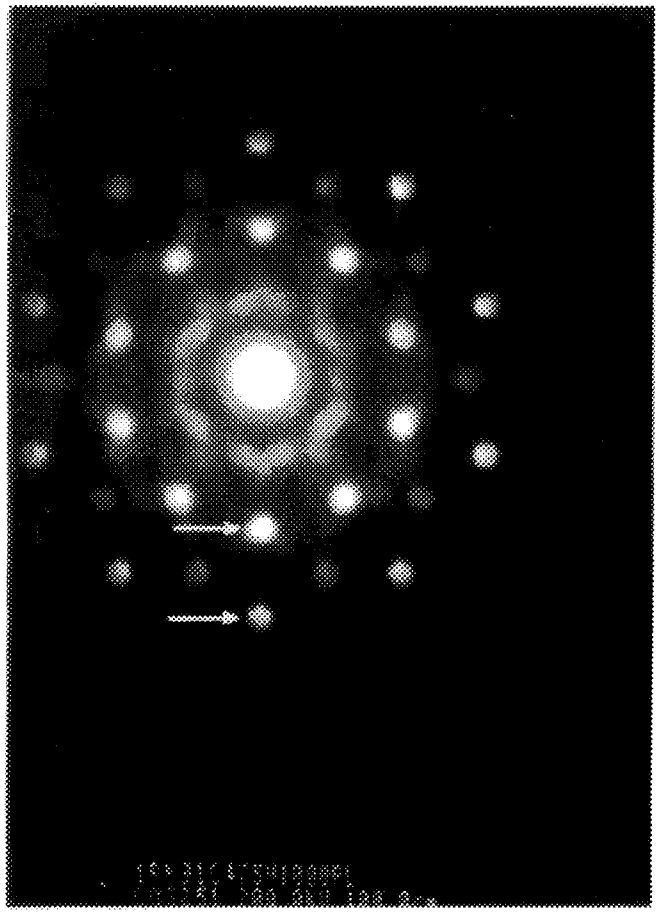
FIG. 2 is an x-ray diffraction pattern of quasicrystalline structure as formed in the iron-based alloy of the present invention.

Analysis of diffraction patterns from such particles showed absence of translation symmetry indicating that the particles are not perfectly crystalline. A series of diffraction patterns taken in various directions in the crystal showed that it was possible to obtain patterns with symmetries that are characteristic of quasicrystals. Measurements of the ratio between the length of reciprocal lattice vectors showed values close to 1.62, which is in good agreement with the golden mean found in quasicrystals, as identified in the Kelton article cited above. An example of a diffraction pattern showing both five-fold symmetry and golden mean between the absolute values of lattice vectors (indicated by arrows) is shown in FIG. 2.

As in the case of quasicrystalline structures, five-fold symmetries can be produced in diffraction patterns from twinned structures. In order to exclude the possibility of twinning a thorough investigation of the microstructure was performed in a HREM. Images at atomic resolution were digitized and Fourier transformed. The diffraction patterns obtained from very small areas using this method showed perfect agreement with the diffraction patterns obtained using conventional diffraction of larger areas, thereby proving that twinning is not the cause of five-fold symmetry in the present case. This conclusion was further confirmed by employing the inverse Fourier transform of already transformed patterns whereby no twinning could be observed in the real image thus obtained.

Chemical analysis using energy dispersive X-ray analysis of the quasicrystalline particles showed a typical chemical composition of 5% silicon, 15% chromium, 30% iron and 50% molybdenum. It was concluded from the investigation of the present experimental steel that molybdenum and chromium were necessary alloying elements to obtain precipitation of quasicrystals in iron-based alloys.

Quasicrystals in metals and alloys are usually formed during rapid quenching from the liquid state according to the Kelton article. This was first reported in 1984 for an Al-14% MN alloy in D. Schechtman, I. Blech, D. Gradias and J. W. Cahn, *Phys. Rev. Lett.*, vol. 52, p. 1951, 1984. There are also reports on the solid state formation of quasicrystals in supersaturated rapidly quenched alloys (See, P. Lui, G. L. Dunlop and L. Arnberg, *International Journal Rapid Solidification*, vol. 5, p. 229, 1990). However, there are very few reports of the formation of quasicrystals in conventionally produced alloys during an isothermal heat treatment in the solid state. The only report of such an observation that has been found is from a ferritic-austenitic steel (See, Z. W. Hu, X. L. Jiang, J. Zhu and S. S. Hsu, *Phil. Mag. Lett.*, vol. 61, no. 3, p. 115, 1990). These authors found quasicrystalline phases after extremely long tempering times, viz 1000 h or more. However, these phases were not associated with precipitation strengthening. The alloy of the present invention is therefore unique in that it involves the isothermal formation of quasicrystalline precipitates that are used for precipitation strengthening of conventionally produced alloys and metals in the solid state. By strengthening is here meant an increase in tensile strength of the alloy to a level of at least 200 MPa or usually at least 400 MPa as a result of a thermal treatment.

There are at least two advantages of using quasicrystals as strengthening objects during tempering. First, the strengthening effect is higher than for crystalline precipitates owing to the difficulty of dislocations to move through a quasicrystalline lattice. Second, precipitate growth above a certain size is very difficult since large quasicrystals are difficult to form. Both these statements are confirmed by the observations in the present study since the strengthening effect and the resistance to overaging in the experimental steel are extremely high. No evidence of softening was observed during tempering experiments up to temperatures of 500° C. and times of 1000 h, as can be seen in the Table below. Furthermore, the strength increment during tempering is usually about 800 MPa and can in extreme cases be as high as 1000 MPa, which is quite a remarkable result.

An example of the hardening response under comparable conditions in the same temperature range using a precipitation reaction in a conventional maraging steel of a composition in accordance with U.S. Pat. No. 3,408,178 is given in the Table below for comparison. This is an example of softening behavior of a crystalline precipitation reaction.

Thus, it can be concluded that the above-mentioned hardening mechanism involving precipitation of quasicrystalline particles give rise to an exceptionally high strength increment during tempering in combination with a resistance to overaging that is unique among alloys in general. These properties are intimately related to the precipitates being quasicrystalline and cannot be expected in association with conventional precipitation since crystalline precipitates are much more deformable and are likely to undergo coarsening in accordance with so-called Ostwald ripening mechanism. In the alloy system of the present invention, precipitation of quasicrystals occurred in the martensitic matrix. It is therefore concluded that the said mechanism is favored by a martensitie or the closely related ferritic structure both of which for practical purposes can be regarded as body centered cubic (bcc) structures. It is expected that the said mechanism can occur also in other structures such as face centered cubic (fcc) and close packed hexagonal (cph) structures. Thus, the present invention is applicable across a broad range of steels and iron-based alloys. This hardening mechanism has been demonstrated to occur in the temperature range 375°–500° C. but since this mechanism is dependent on the alloy composition it can be expected to occur in a much wider range in general, viz below 650° C. Usually, temperatures below 600° C. are expected to be used, preferably temperatures below 550° C. or 500° C. A recommended minimum temperature is in practice 300° C., preferably 350° C. The tempering treatment can be performed isothermally but tempering treatments involving a range of various temperatures can also be envisaged. At a tempering temperature of 475° C., it was found that the quasicrystalline particles had reached a typical diameter of 1 nm after 4 h and a typical diameter of 50–100 nm after 100 h, after which no substantial growth occurred. A particle diameter typically in the range 0.2–50 nm is expected after 4 h, while diameters typically in the range 5–500 nm are expected after 100 h. It is also expected that a minimum of either 0.5 weight % molybdenum, 0.5 weight % molybdenum and 0.5 weight % chromium, or at least 10 weight % chromium in stainless steels is required to form quasicrystalline precipitates as a strengthening agent in iron-based steels or iron group alloys. The experimental steel used herein to demonstrate the strengthening potential of stainless steels and to show the unique properties of quasicrystals can be regarded as a conventional stainless steel in the sense that only conventional alloying elements are present and in the sense that also conventional crystalline precipitation can occur in various amounts, both within the temperature range where quasicrystals are formed, and outside this range. It should be emphasized that quasicrystalline precipitates was the major type of precipitate in the present steel below 500° C. Above 500° C., the fraction of quasicrystalline precipitates diminished and gradually became a minority phase, the majority being crystalline precipitates. In general, it can be expected that the described mechanism can occur in a rather wide range of tempering temperatures employed in practice where crystalline precipitation normally takes place, i.e., below temperatures of approximately 650° C. It can also be expected to occur in all other alloy systems in which quasicrystals have been observed to form under cooling. Quasicrystalline precipitation is thus expected to give rise to precipitation hardening in a wide variety of alloy systems other than steels and iron-based alloys, such as copper-, aluminum-, titanium-, zirconium- and nickel-alloys, wherein the minimum amount of base metal is 50%. In the case of iron group alloys, the sum of chromium, nickel and iron should exceed 50%.

The alloys of the present invention can be used in the manufacture of medical and dental elements as well as spring or other applications. An alloy with a precipitation mechanism according to the present invention can also be used in the making of various products such as wire in sizes less than Ø15 mm, bars in sizes less than Ø70 mm, strips in sizes of thicknesses less than 10 mm and tubes in sizes with outer diameter less than 450 mm and wall thickness less than 100 mm.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

TABLE

HARDNESS HVI
Tempering Temperatures

| | Experimental Steel | | | | U.S. Pat. No. 3,408,178 | |
|---|---|---|---|---|---|---|
| Time (min) | 375° C. | 425° C. | 475° C. | 500° C. | 475° C. | 500° C. |
| 0.01 | 427 | 427 | 427 | 427 | 321 | 321 |
| 0.2 | 473 | 489 | 543 | 585 | 402 | 520 |
| 0.6 | 474 | 501 | 566 | 592 | 416 | 436 |
| 1 | 479 | 507 | 577 | 609 | 428 | 465 |
| 2 | 485 | 524 | 584 | 610 | 450 | 493 |
| 4 | 503 | 542 | 631 | 612 | 482 | 517 |
| 6 | 523 | 550 | 616 | 617 | 482 | 526 |
| 12 | 511 | 587 | 636 | 523 | 515 | 538 |
| 20 | 532 | 590 | 630 | 625 | 538 | 533 |
| 36 | 534 | 608 | 657 | 622 | 545 | 549 |
| 60 | 535 | 631 | 636 | 631 | 567 | 571 |
| 120 | 533 | 649 | 654 | 628 | 563 | 556 |
| 240 | 591 | 636 | 660 | 650 | 567 | 533 |
| 480 | 604 | 655 | 660 | 665 | 567 | 540 |
| 960 | 620 | 655 | 660 | 665 | 561 | 533 |
| 1920 | 664 | 675 | 681 | 677 | 558 | 515 |
| 3840 | 681 | 681 | 699 | 645 | 542 | 519 |
| 6000 | 679 | 716 | 680 | 658 | 545 | 495 |
| 10100 | 703 | 717 | 697 | 659 | 527 | 475 |
| 20200 | 730 | 731 | 694 | 659 | 509 | 463 |

What is claimed is:

1. A precipitation hardened iron-based alloy which has been strengthened by the precipitation of particles wherein the particles have a quasicrystalline structure, said structure being essentially obtained at aging times up to 1000 h and tempering treatments up to 650° C., the strengthening involving an increase in tensile strength of the alloy of at least 200 MPa over said iron-based alloy prior to tempering, wherein the alloy contains at least 0.5% by weight of molybdenum and at least 0.5% by weight of chromium.

2. The precipitation hardened iron-based alloy of claim 1 wherein the total of chromium, nickel and iron exceeds 50% of the alloy.

3. The precipitation hardened iron-based alloy of claim 1 wherein the tempering treatment is in the range 300°–650° C.

4. The precipitation hardened iron-based alloy of claim 1 used in the manufacture of medical and dental components.

5. Wire of a diameter less than 15 mm in diameter comprised of the precipitation hardened iron-based alloy of claim 1.

6. Bars in sizes less than 70 mm in diameter comprised of the precipitation hardened iron-based alloy of claim 1.

7. Strip in sizes less than a thickness of 10 mm comprised of the precipitation hardened iron-based alloy of claim 1.

8. Tubes in sizes with outer diameter less than 450 mm and wall thickness less than 100 mm comprised of the precipitation hardened iron-based alloy of claim 1.

9. The precipitation hardened alloy of claim 1 wherein the iron-based alloy is a maraging steel.

10. A precipitation hardened iron-based alloy which is strengthened by tempering at temperatures of up to 650° C. for up to 1000 h, wherein the tempering causes precipitation of quasicrystalline particles which increase a tensile strength of the alloy by at least 200 MPa over the iron-based alloy prior to tempering.

11. A method of precipitation hardening an iron-based alloy comprising tempering the iron-based alloy at temperatures of up to 650° C. for up to 1000 h to cause precipitation of quasicrystalline particles which increase a tensile strength of the alloy by at least 200 MPa over the iron-based alloy prior to tempering.

* * * * *